US005234285A

United States Patent [19]

Cameron

[11] Patent Number: 5,234,285

[45] Date of Patent: Aug. 10, 1993

[54] MARINE RAILWAY SYSTEM

[76] Inventor: Walter N. Cameron, P.O. Box 22, Drummond Island, Mich. 49726

[21] Appl. No.: 841,720

[22] Filed: Feb. 26, 1992

[51] Int. Cl.[5] ..... B63C 3/08

[52] U.S. Cl. ..... 405/2; 114/344; 104/173.1

[58] Field of Search ..... 405/1, 2, 3, 4; 114/44, 114/344; 280/414.1; 104/169, 173.1

[56] References Cited

U.S. PATENT DOCUMENTS

| | | | |
|---|---|---|---|
| 390,543 | 10/1888 | Woods | 405/2 |
| 486,012 | 11/1892 | Woods | 405/2 |
| 1,585,193 | 5/1926 | Haalack | 405/2 |
| 2,371,461 | 3/1945 | Newell | 114/355 X |
| 2,442,248 | 5/1948 | Sampsell | 114/344 X |
| 2,933,328 | 4/1960 | McIntyre et al. | 280/414.1 X |
| 4,160,611 | 7/1979 | Hveding | 405/2 |
| 4,243,344 | 1/1981 | Gardon | 405/2 |
| 4,507,016 | 3/1985 | Honour, VIII | 405/2 |
| 4,595,313 | 6/1986 | Kotke | 405/2 |
| 4,641,996 | 2/1987 | Seal | 405/2 |
| 4,745,873 | 5/1988 | Mott | 405/2 X |
| 5,004,260 | 4/1991 | Smyly, Sr. | 114/344 X |

FOREIGN PATENT DOCUMENTS

| | | | |
|---|---|---|---|
| 2631088 | 1/1978 | Fed. Rep. of Germany | 405/2 |

*Primary Examiner*—Dennis L. Taylor
*Assistant Examiner*—Arlen L. Olsen
*Attorney, Agent, or Firm*—Waters & Morse

[57] ABSTRACT

A marine railway has a carriage pivotally connected to a support frame near the front of the carriage, and on a transverse horizontal axis. The rear of the support frame is carried by compression springs resting on the carriage. The support frame is provided with support abutments that are adjustable to accommodate the contour of the boat. A cable loop extends from a submerged pulley at the outer end of the railway, and engages a winch activated by a remote control unit. The carriage is interposed in one side of the loop.

5 Claims, 5 Drawing Sheets

MARINE RAILWAY SYSTEM

BACKGROUND OF THE INVENTION

Launching and hauling out small boats is becoming more and more difficult where special facilities are not provided. Larger and larger outboard engines add to the problem. These have gone well beyond the point where a man can unclamp the engine from the transom, lift it off, and carry it over to the trunk of his car. Small boats that used to be appropriate for local fishing now do double duty for water-skiing, and with a consequent increase in required horsepower. Deep trolling in large bodies of water has also shifted emphasis to much more substantial and seaworthy hulls.

Moving these more massive boats into and out of the water becomes further complicated if the shoreline is strewn with sizeable rocks, rather than providing a smooth sand beach. Running the boat up on the shore becomes out of the question. Marine railways have come into common use by owners of shoreline property. Even these installations present problems in rough weather. Wave action can bounce the boat to the point that it drops down hard enough on the railway carriage to damage the hull. In the usual case, a boat operator must somehow get to and from his boat while it is afloat, and the bouncing of wave action can easily shift the boat out of the aligning effect of the carriage. The operator usually has to walk around in knee-deep water in the midst of the rocks, as a conventional marine railway is moved by winch and cable controlled from on-shore.

SUMMARY OF THE INVENTION

The present invention provides a marine railway that can significantly reduce the possibility of damage due to the effects of rough water This is accomplished by providing a support frame pivoted to a carriage on a transverse horizontal axis near the front of the carriage, which is the end last to enter the water on a railway intersecting the shoreline. The opposite end of the support frame is carried on compression springs resting on the carriage. The carriage is interposed in a cable loop which is positioned at the outer end of the railway by a pulley mounted near the bottom of the body of water. The cable loop is moved by a winch activated by a remote control unit carried in the boat.

DESCRIPTION OF THE PREFERRED EMBODIMENTS

Figure 1:
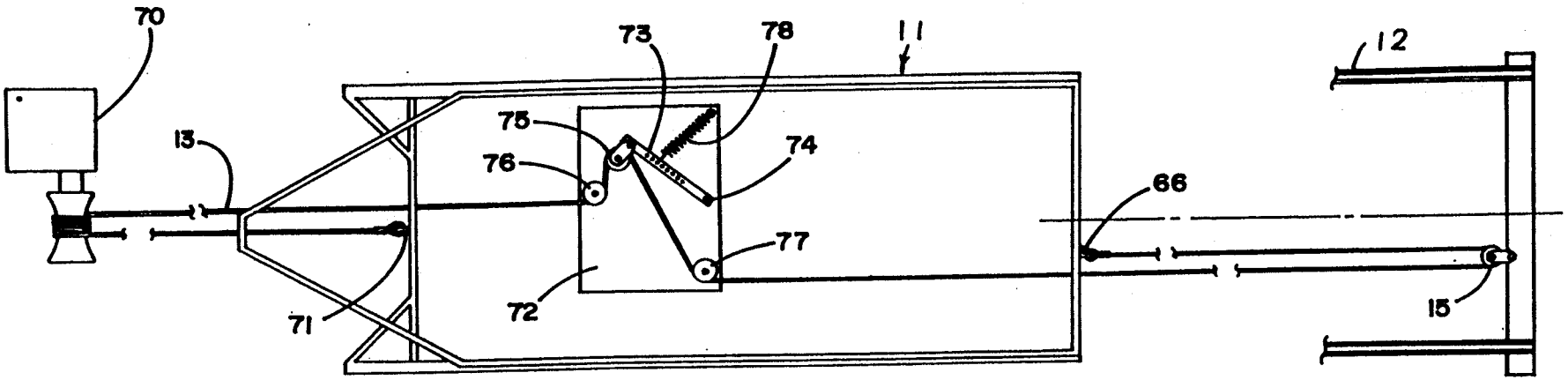
FIG. 1 is a plan view of a marine railway installation embodying the present invention. The actual structure of the carriage is omitted to avoid obscuring the cable system.
Figure 10:
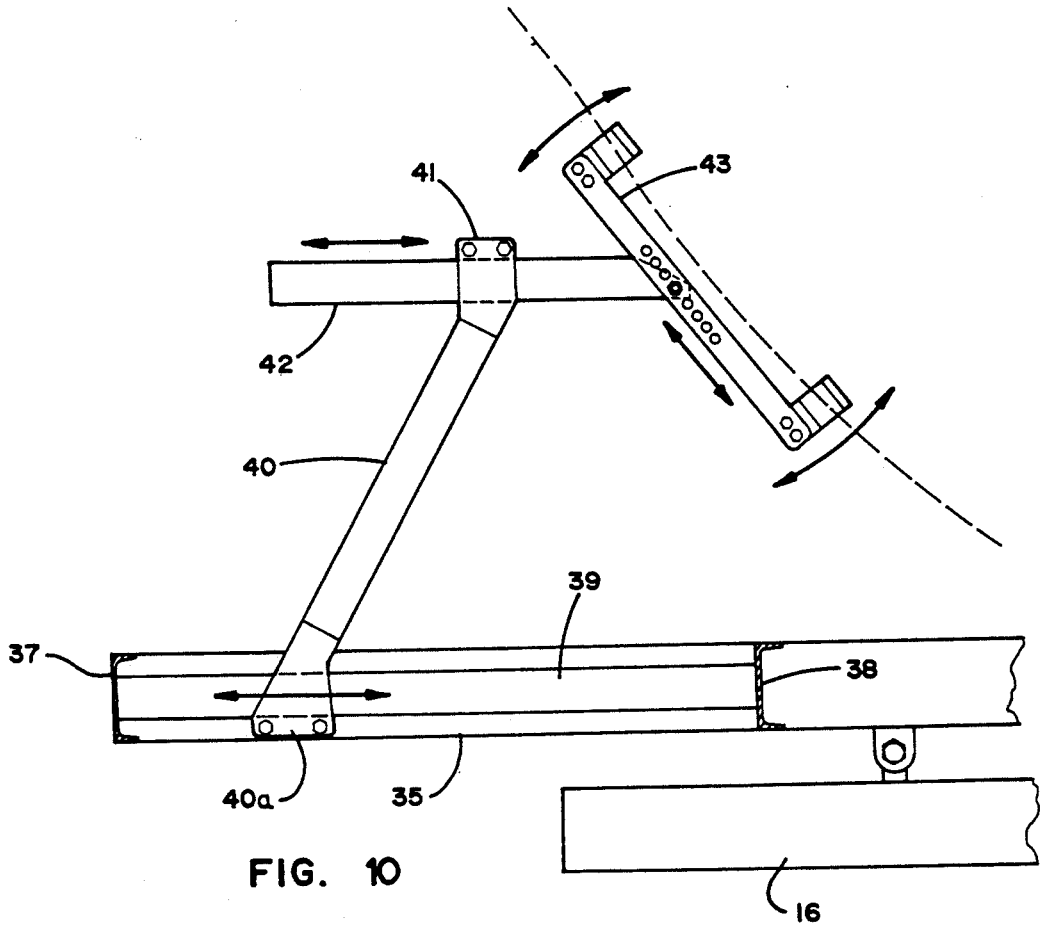
FIG. 10 is a fragmentary view of an enlarged portion of FIG. 4 showing the adjustable bow support for the boat.
Figure 3:
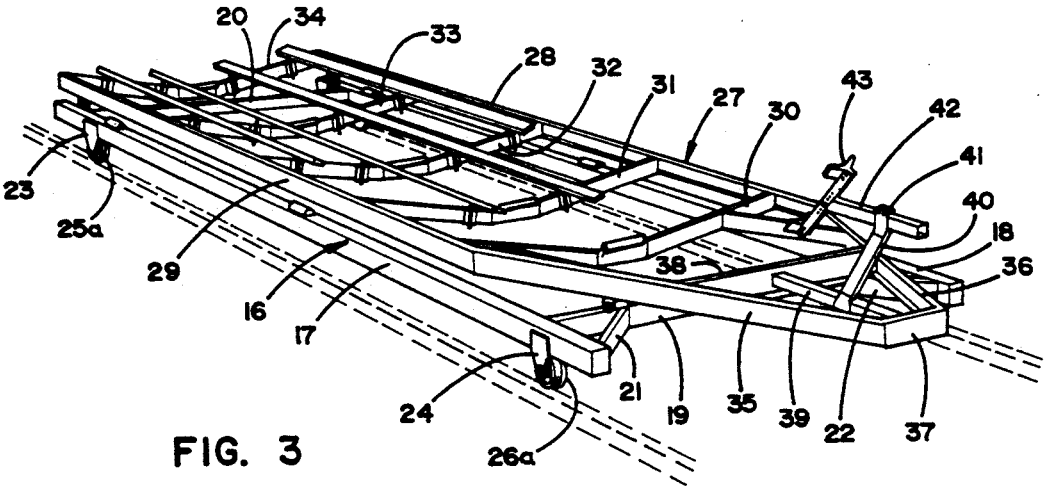
FIG. 3 is a perspective view of the complete carriage assembly.
Figure 4:
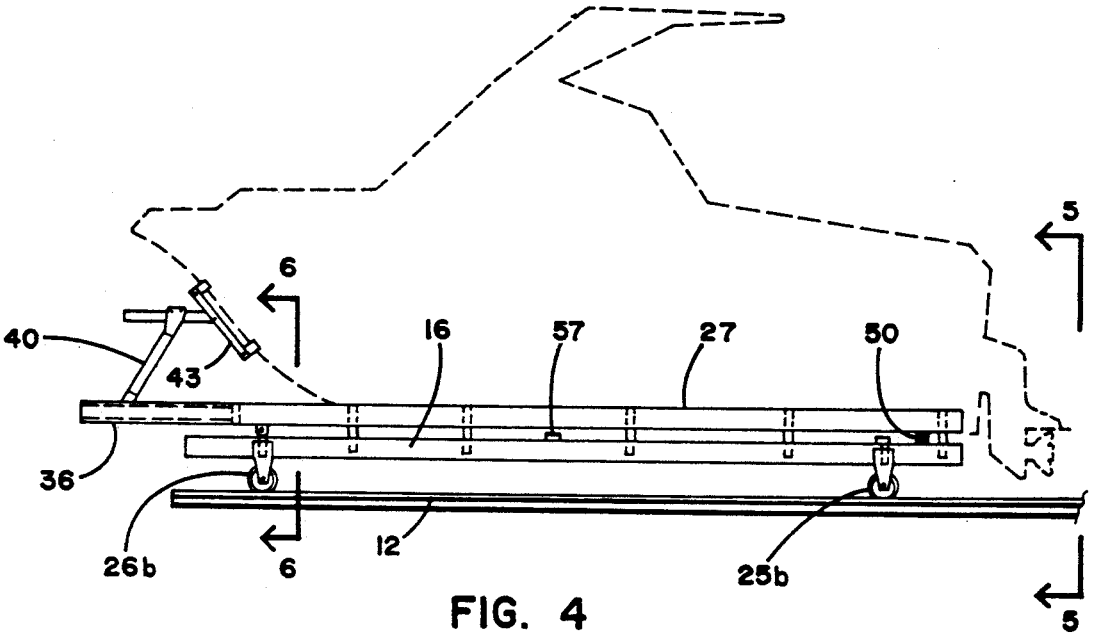
FIG. 4 is a side elevation of the carriage assembly shown in FIG. 3.

Referring to FIGS. 1 and 3 the boat generally indicated at 10 is shown supported on the carriage 11 riding on the marine railway 12. A cable loop 13 extends around the pulley 15. Referring to FIG. 3, the carriage includes the lower frame member generally indicated at 16, which includes the side members 17 and 18, the transverse front member 19 and rear member 20, together with front corner braces as shown at 21 and 22. On both sides of the carriage, brackets are provided as shown at 23 and 24 for supporting the wheels 25*a–b* and 26*a–b* that engage the rails. The upper frame generally indicated at 27 includes the side members 28 and 29, and the transverse members 30–34. A converging forward section of the upper frame is formed by the members 35–37, together with a cross member 38 and the short beam 39 interconnecting the members 37 and 38. This short beam forms the support for the clamp 40*a* (see FIG. 10) on the post 40 carrying the clamp 41 adjustably receiving the member 42 carrying the receptacle 43 positioned to engage the bow of a boat carried by the carriage.

Figure 7:
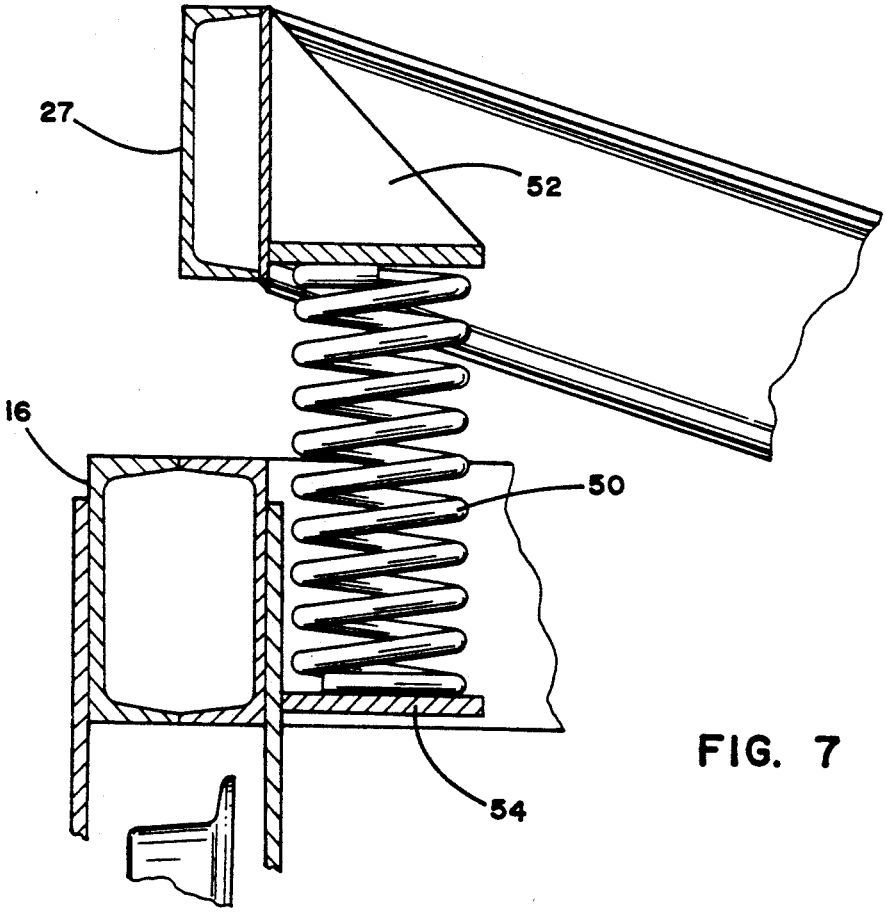
FIG. 7 is an enlarged fragmentary sectional elevation showing the spring installation at the rear of the support frame.
Figure 6:
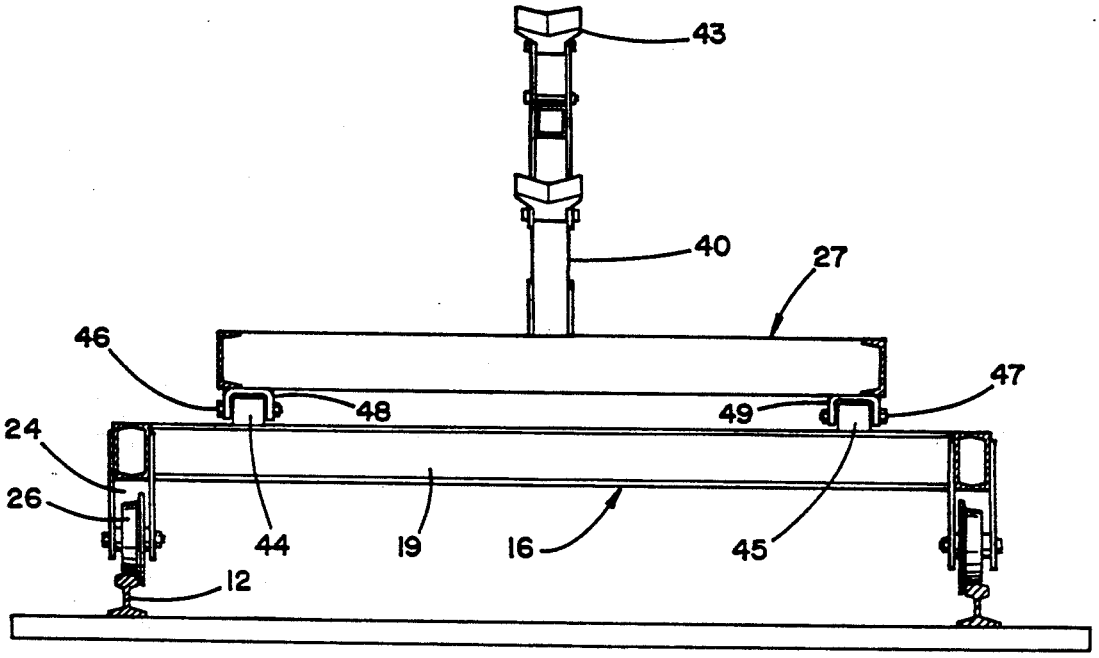
FIG. 6 is a front view of the carriage assembly, with the boat removed.
Figure 5:
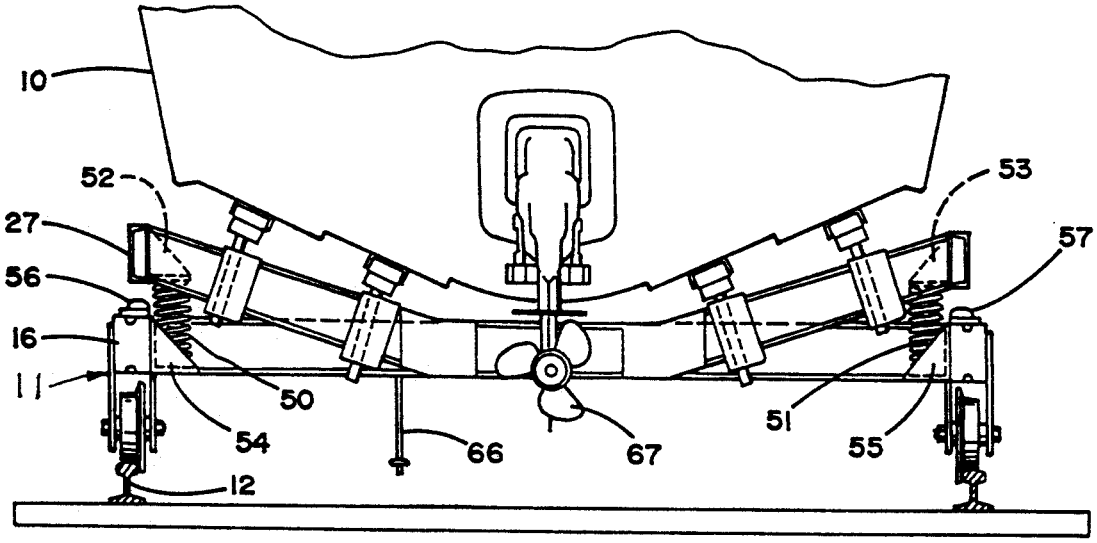
FIG. 5 is a rear view of the carriage assembly, with the lower portion of the boat in position on the support frame.

The upper frame 27 is pivotally connected to the bearings 44 and 45 on the lower frame member 19, by the bolts 46 and 47 traversing the brackets 48 and 49 on the upper frame 27. This arrangement results in a pivotal interconnection between the upper and lower frames on a transverse horizontal axis. Referring to FIGS. 5 and 7, the rear of the upper frame is supported by the springs 50 and 51 acting between the brackets 52 and 53 on the upper frame and the brackets 54 and 55 on the lower frame. The springs are preferably coiled compression springs of standard configuration. To prevent over travel of these springs from severe jostling, it is preferable to incorporate a group of resilient bumpers as shown at 56 and 57 in FIG. 5 interposed between the side members of the upper and lower frames. The vertical resilience provided by the spring system permits the carriage to support the boat gently in the midst of significant wave action. The boat is also kept in alignment in the carriage, so that it is not knocked broadside to the wave action.

Figure 8:
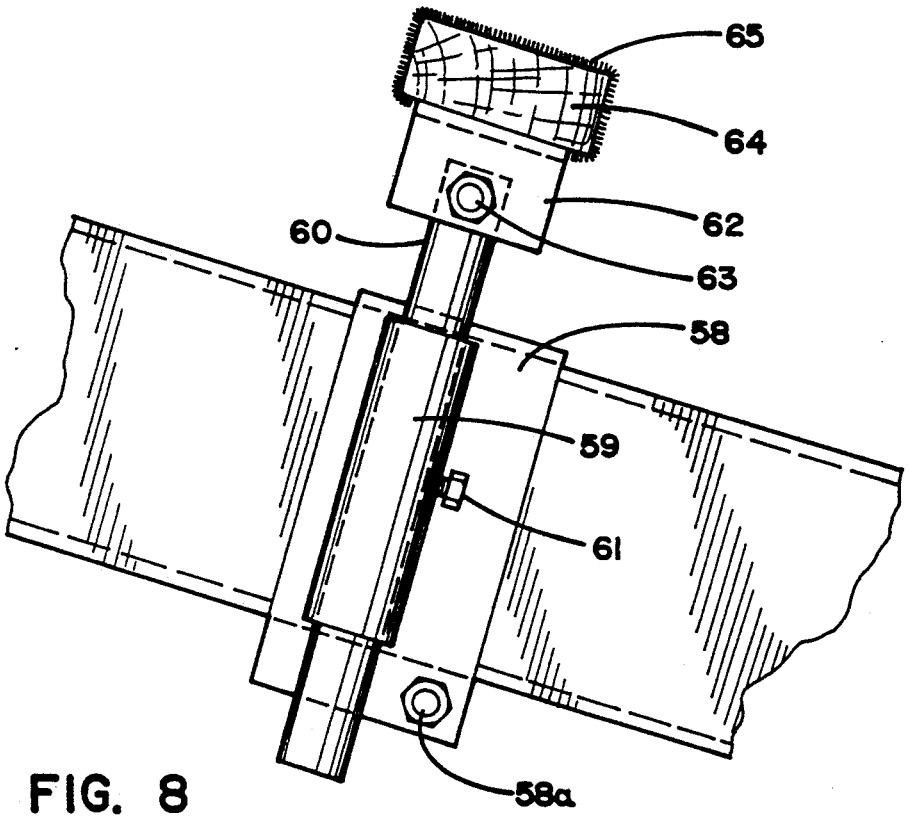
FIG. 8 is an enlarged fragmentary view showing the adjustable support abutment in side elevation.
Figure 9:
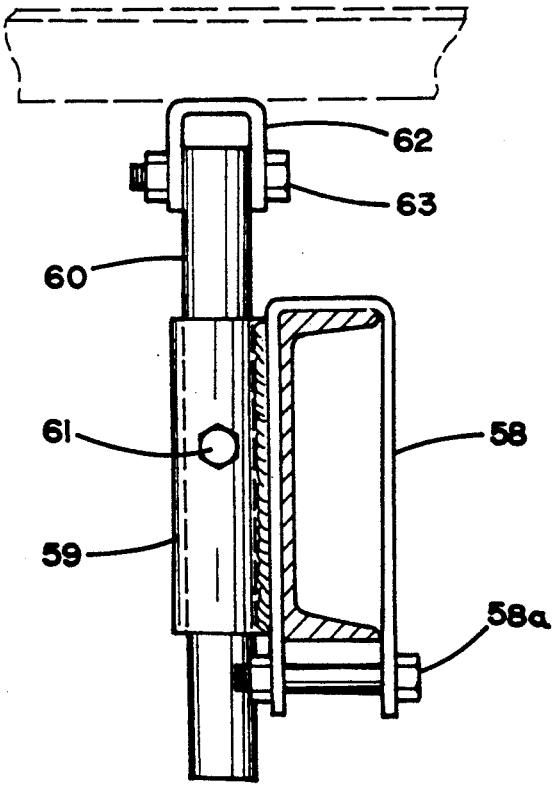
FIG. 9 is a view similar to FIG. 8, showing the structure in front elevation.

The boat is supported and aligned on the carriage by the adjustable supports in FIGS. 8 and 9. Clamps as shown at 58 are secured by bolts 58*a* installed on the cross members of the upper frame at selected positions. The sleeves 59 are welded to the clamps 58, and function as guides for the tubular members 60 in a sliding relationship that can be locked by tightening the set screws 61. The upper ends of the tubular members 60 are secured to the brackets 62 with the bolts 63. Preferably, a wooden plank 64 is secured to the brackets 62, and is covered with any convenient material 65 to form a gentle support against the bottom of the boat.

Figure 2:
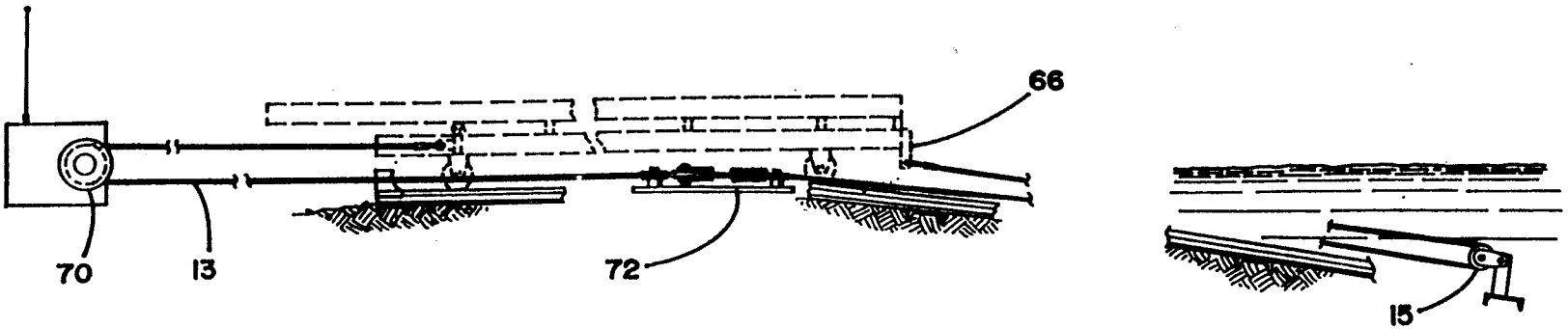
FIG. 2 is a side elevation with respect to FIG. 1.

Referring to FIGS. 1 and 2, the cable arrangement for moving the carriage along the rails to launch and haul out the boat can take a variety of configurations. It is preferable that the cable 13 be connected at one point to the terminal horn 66 (refer to FIG. 5) welded to either the upper or lower frame about a foot off-center, and extending well below the position of the propeller 67 on a boat 10 supported on the carriage. This keeps the cable well out of a position where it could become entangled with the propeller. The opposite end of the cable can be run from the winch fairly close to the centerline of the rail system to a point of connection to the carriage at 71. Both sides of the loop are thus fed to the winch 70, which is then able to move the boat in either direction along the railway, according to the direction of rotation of the winch. The winch operation is energized by a conventional remote control unit, which is kept aboard the boat, and operated in the manner of a garage door opener. A cable tensioning system is mounted on the plate 72 secured to the ties of the railway 12. This system includes the arm 73 pivoted to the plate 72 at 74. The arm has a pulley 75 at its outer end. The cable is centrally positioned by the fixed pulley 76 mounted on the plate, and the cable passes from there to the movable pulley 75, and then to the offset fixed pulley 77 mounted on the plate 72 in alignment with the submerged pulley 15. From that point, the cable extends to the connection at the horn 66. A tension spring 78 biases the arm 73 to maintain tension in the cable.

I claim:

1. A marine railway carriage, comprising:

a lower frame having substantially parallel spaced sides and provided with railway wheels;

an upper frame pivotally connected to said lower frame at spaced points adjacent said sides, respectively, on a transverse horizontal axis adjacent the normally forward end of said lower frame;

spring means connected at the opposite ends thereof to said lower and upper frame, respectively, adjacent the normally rear end of said lower frame, and biasing said frames toward separation; and support means on said upper frame adapted to engage a boat.

2. A marine railway, comprising:

rail means intersecting the edge of a body of water;

carriage means engaging said rail means;

motive means including at least one pulley mounted below the level of said body of water at a position fixed with respect to said rail means, and also including a continuous cable loop engaging said pulley, and winch means adapted to drive said cable loop in opposite directions to induce movement of said carriage along said rail means, said loop having opposite sections, said carriage being interposed in one of said sections; and remote control means operative to control said winch means.

3. A marine carriage system, comprising:

a carriage having supporting wheels;

a continuous cable loop connected to said carriage;

pulley means mounted below the level of a body of water outward from the shoreline thereof and engaging said cable loop;

winch means including a capstan engaging said cable loop and adapted to induce motion in said cable loop in opposite directions transverse to said shoreline;

cable-tension means engaging a section of said loop and interposed between said pulley means and said capstan; and remote control means operative to control said winch means.

4. A marine railway carriage, comprising:

a lower frame provided with wheels;

an upper frame pivotally connected to said lower frame on a transverse horizontal axis adjacent the normally forward end of said lower frame;

spring means connected at the opposite ends thereof to said lower and upper frame, respectively, adjacent the normally rear end of said lower frame, and biasing said frames toward separation;

a winch and cable system connected to said carriage, and a remote control for said system, said cable system including a cable loop having opposite sections, said carriage being interposed in one of said sections, and further including cable-tension means engaging said loop and interposed between said pulley means and said winch means; and support means on said upper frame adapted to engage a boat.

5. A marine railway carriage, comprising:

a lower frame provided with wheels;

an upper frame pivotally connected to said lower frame on a transverse horizontal axis adjacent the normally forward end of said lower frame;

spring means connected at the opposite ends thereof to said lower and upper frame, respectively, adjacent the normally rear end of said lower frame, and biasing said frames toward separation;

a cable terminal secured to said carriage and extending downward therefrom at an eccentric position on said lower frame; and support means on said upper frame adapted to engage a boat.

* * * * *